US007223932B2

(12) United States Patent
Kobayashi et al.

(10) Patent No.: US 7,223,932 B2
(45) **Date of Patent: *May 29, 2007**

(54) VACUUM SWITCHGEAR

(75) Inventors: Masato Kobayashi, Hitachi (JP); Kenji Tsuchiya, Hitachi (JP); Satoru Kajiwara, Hitachi (JP); Daisuke Sugai, Hitachi (JP); Hironori Tonosaki, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/455,866

(22) Filed: Jun. 20, 2006

(65) Prior Publication Data

US 2006/0237394 A1 Oct. 26, 2006

Related U.S. Application Data

(63) Continuation of application No. 10/845,110, filed on May 14, 2004, now Pat. No. 7,135,652.

(30) Foreign Application Priority Data

May 19, 2003 (JP) ..... 2003-140761

(51) Int. Cl.
*H01H 33/66* (2006.01)

(52) U.S. Cl. ..... 218/155; 218/10; 218/110; 218/134

(58) Field of Classification Search ..... 218/2, 218/10, 7, 14, 118–120, 134–136, 139, 140, 218/152–155
See application file for complete search history.

(56) References Cited

U.S. PATENT DOCUMENTS 3,983,345 A 9/1976 Phillips
4,297,553 A 10/1981 Kawaguchi et al.
4,879,441 A 11/1989 Hamm et al.
6,335,502 B1 1/2002 Kikukawa et al.
6,426,627 B2 * 7/2002 Kikukawa et al. ..... 218/122
6,498,314 B2 12/2002 Miyo et al.
6,884,940 B1 * 4/2005 Utsumi et al. ..... 218/118
2001/0040146 A1 11/2001 Miyo et al.

FOREIGN PATENT DOCUMENTS

JP 2000-268685 9/2000

* cited by examiner

*Primary Examiner*—Elvin Enad
*Assistant Examiner*—M. Fishman
(74) *Attorney, Agent, or Firm*—Mattingly, Stanger, Malur & Brundidge, P.C.

(57) ABSTRACT

Disclosed is a vacuum switchgear comprising an electroconductive outer vacuum container, a plurality of inner container disposed in the outer vacuum container. The inner containers and the outer container are electrically isolated from each other. The outer container is made of stainless steel plate, for example. One of the inner vacuum containers accommodates a ground switch for keeping the circuit open while the switchgear is opened, having a movable electrode connected to an operating mechanism, and a fixed electrode connected to fixed electrode rod. Another inner vacuum container accommodates a function switch capable of having at least one of functions of a circuit breaker, a disconnector and a load switch. A plurality of electrode shields each surrounds the electrodes of the ground switch and of the function switch. The ground switch and the function switch are disposed in separate vacuum inner containers, respectively.

11 Claims, 2 Drawing Sheets

VACUUM SWITCHGEAR

This is a continuation application of U.S. Ser. No. 10/845,110, filed May 14, 2004 now U.S. Pat. No. 7,135,652.

CLAIM OF PRIORITY

The present application claims priority from Japanese application serial No. 2003-140761, filed on May 19, 2003, the content of which is hereby incorporated by reference into this application.

DETAILED DESCRIPTION OF THE INVENTION

1. Technical Field of the Invention

The present invention relates to a vacuum switchgear, and more particularly to a vacuum switchgear provided with a plurality of switches in a vacuum container, which is suitable for a power distribution-transmission system.

2. Related Art

As one of components for a power distribution-transmission system, the distribution system has a switchgear. Air insulation type switchgears have been used for the distribution-switches; gas insulation type switchgears using $SF_6$ gas as an insulation medium have become used so as to downsize the system. However, the gas insulation type switchgears may give an adverse affect on environment; vacuum type switchgears have recently been proposed.

As switchgears of vacuum insulation type, a plurality of main circuit switches each comprising a movable electrode, a fixed electrode disposed to face the movable electrode is disposed in a vacuum container, wherein the movable electrode is connected to a conductor of a bus, and the fixed electrode is connected to a load conductor. Each of the electrodes of the main bus switches is covered with a shield, and each of the buses is connected by means of a flexible conductor as disclosed in Japanese Patent Laid-open 2000-268685. The content of the publication may be incorporated into the part of the present specification.

In the above mentioned art, since each of the main switches is covered with an arc shield, a trip action is performed at the time of a short-circuit accident, for example. Thus, when the movable electrode and the fixed electrode are separated, generated metallic vapor is shielded by the arc shield. However, since part of the metallic vapor may disperse or scatter through the gap between the arc shields to adhere or deposit on the vacuum container, it has been tried to form a dual vacuum container to prevent the scattering or dispersing of metallic vapor.

If the inner vacuum container is closed from or not communicated with the outer vacuum container, the vacuum degree or vacuum pressure of the inner vacuum container where the movable electrodes and fixed electrode are disposed may temporarily drop due to gases evolved from the melted electrodes. The gasses may be contained in the materials of the switchgear such as electrodes, shields, etc. Therefore, it is necessary to enlarge the volume of the inner vacuum container so as to maintain desired insulation resistance. As the number of switching operation time increases, the vacuum degree hardly recover to the predetermined value. As a result, the insulation resistance will decrease. If the volume of the inner vacuum container is enlarged, the size of the vacuum switchgear enlarges.

SUMMARY OF THE INVENTION

It is an object of the present invention to provide a vacuum switchgear, which can be downsized, keeping desired insulation resistance. One aspect of the vacuum switchgear according to the present invention comprises an outer vacuum container made of or having an electro-conductive material, a plurality of inner vacuum container insulated from the outer vacuum container, a plurality of switches each being disposed in each of the inner vacuum containers, wherein the outer vacuum containers and the inner vacuum containers are communicated with through-holes formed in the walls of the inner vacuum containers.

DETAILED DESCRIPTION OF THE PREFERRED EMBODIMENTS

Figure 1:
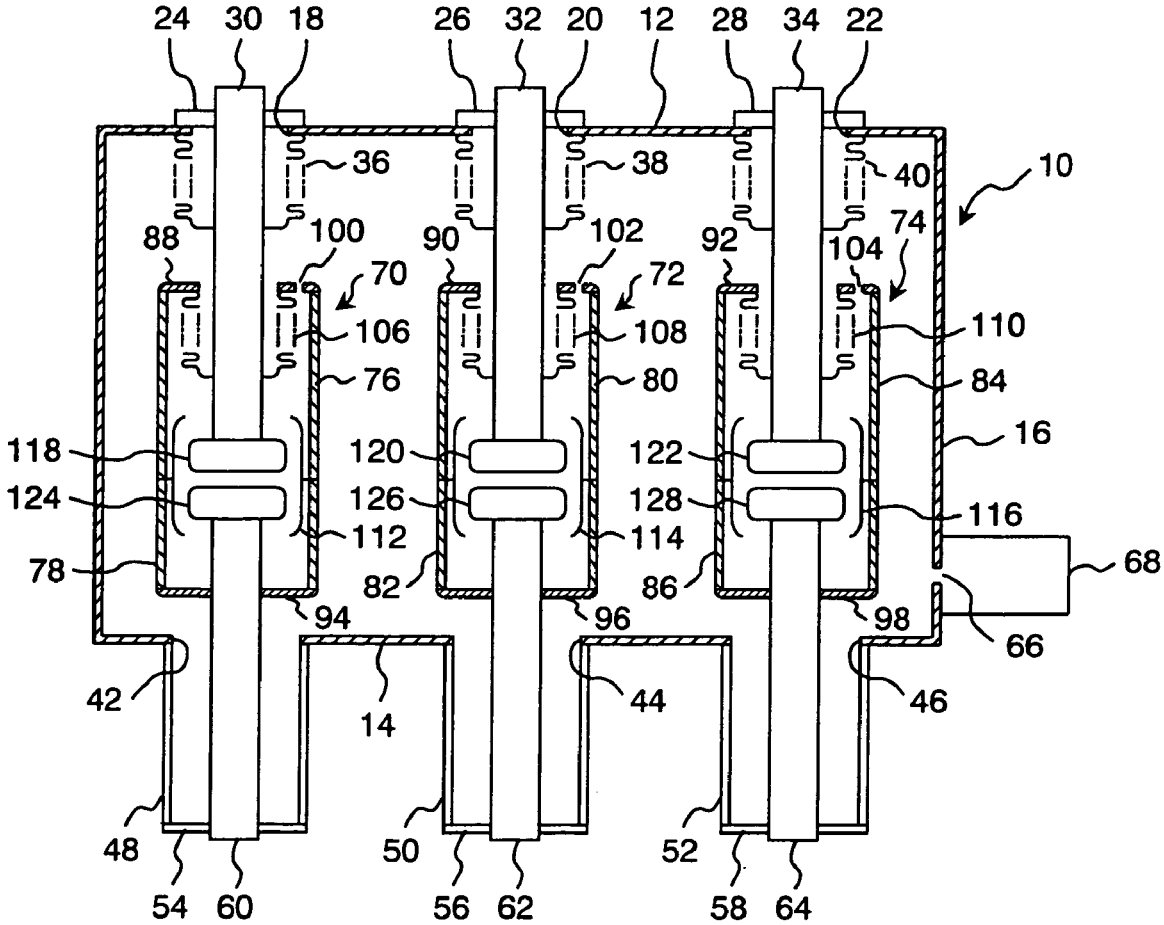
FIG. 1 is an elevational cross sectional view of the vacuum switchgear of an embodiment according to the present invention.

Before describing the embodiments in details, several aspect of the present invention will be explained.

At first, another aspect of the present invention provides a vacuum switchgear comprising an electro-conductive outer vacuum container, a plurality of inner containers disposed in the outer vacuum container, the inner containers and the outer container being electrically isolated from each other. The outer container is made of stainless steel plate, for example.

One of the inner vacuum containers accommodates a ground switch for keeping the circuit open while the switchgear is opened, having a movable electrode connected to an operating mechanism, and a fixed electrode connected to fixed electrode rod. Another inner vacuum container accommodates a function switch capable of having at least one of functions of a circuit breaker for breaking a circuit at the time of accident, a disconnector for disconnecting the circuit at the time of opening the circuit and a load switch for switching the circuit with a load.

A plurality of electrode shields each surrounds the movable electrodes and fixed electrodes of the ground switch and of the function switch. The ground switch and the function switch are disposed separately in separate vacuum inner containers. The outer vacuum container and the inner containers are communicated by means of through-holes formed in the walls of the inner vacuum containers.

The through-holes are formed in at least one of the top and bottom walls of the inner vacuum containers in such a manner that leaking out or scattering of metallic vapor generated at the time of separation of the electrodes into the outer container is prevented by the shields.

The outer vacuum container of the vacuum switchgear is earthed while it is in the circuit or in service.

Each of the movable electrodes of the ground switch and the function switch is connected to a respective operation mechanism (electro-magnetic operator) outside of the outer vacuum container, and wherein each of the fixed electrodes is connected to a cable outside of the outer vacuum container. Since the movable electrode is connected to the operation mechanism which is disposed outside of the vacuum container is well known in the art, the explanation of the operation mechanism is omitted in order to avoid redundancy of the specification. This is the same as cables to which the fixed electrodes are capable of being connected.

Each of the inner vacuum containers is constituted by an insulating hollow body surrounding the movable electrode and the fixed electrode, a top member connected in movement relation to the movable electrode, and a bottom member connected in fixed relation to the fixed electrode.

Still another aspect of the present invention relates to a vacuum switchgear comprising an outer vacuum container being electrically conductive to be earthed, a plurality of inner containers disposed in the outer container, the inner containers and outer container being electrically isolated from each other, and a plurality of switches disposed in the inner container each having a movable electrode with an electrode and a fixed electrode, wherein each of the movable electrodes is connected to an operation mechanism outside of the outer vacuum container, the fixed electrode is connected to a cable outside of the outer vacuum container, and each of the inner containers is communicated with the outer vacuum container by a through-hole disposed in the wall of the inner vacuum container.

Part of the electrode shield is located within an area confined by a straight line connecting the outermost edge of the movable electrode and the through-hole and a straight line connecting the outermost edge of the fixed electrode and the through-hole. According to this structure, the scattering of metal vapor into the outer vacuum container is effectively prevented.

The outer vacuum container is provided with an opening to be connected to a vacuum pressure monitor so that the vacuum degree of the inner vacuum container can rapidly recover to a predetermined value.

The switches are a ground switch for grounding the vacuum switchgear while in opening and at least two function switches selected from a circuit breaker for breaking a circuit at an accident or the like, and a disconnector switch for disconnecting the circuit for a certain period of time.

The function switches are the circuit breaker, the disconnector and a load switch for switching the vacuum switchgear from the load conductor.

In the following, the embodiments of the present invention will be explained in detail by reference to the drawings.

In FIG. 1, the vacuum switchgear comprises an outer vacuum container 10 as one element for a power distribution-transmission system. The container may be made of an electro-conductive material such as stainless steel plate. The outer vacuum container 10 is constituted by an upper plate member 12, a lower plate member 14 and a side plate member 16. The peripheries of these members are united by a suitable manner such as welding.

The outer casing can be earthed when the switchgear is in service. Thus, the maintenance or inspection of the switchgear can be conducted with safety and ease, because operators or inspection staffs can work near the switchgear or they can even touch it.

The upper plate member 12 has through-holes 18, 20, 22. Each of the through-holes 18, 20, 22 is provided with an annular base 24, 26, 28, which is fixed to each of the inner peripheries of the through-holes. There are spaces within the annular bases, where columnar movable electrode rods 30, 32, 34 are fitted in such a manner that the electrode rods are reciprocally moved up and down by means of bellows 36, 38, 40. One end of each of the bellows is fixed to the upper plate member. The other end of the bellows is fixed to the movable electrode rod. One end of each of the electrode rods is capable of being connected to an operation mechanism (not shown), which drives the rods in response to signals given by a control apparatus (not shown) Thus, the outer vacuum container is air-tightly sealed.

A vacuum evacuator (not shown) can be connectable to the upper plate member of the outer vacuum container 10, for example.

There may also be formed through-holes 42, 44, 46 in the lower plate member 14 to which insulating bushings 48, 50, 52 are fixed. Insulating bushings 48, 50, 52 are fixed to the peripheries of the through-holes 42, 44, 46. Insulating bushings 48, 50, 52 air-tightly seal the through-holes 42, 44, 46 and fixed electrode rods 60, 62, 64 with insulating bases 54, 56, 58. One end of each of the fixed electrode rods 60, 62, 64 is connected to a cable or distribution line (not shown).

The side plate member 16 is provided with an aperture 66, which is communicated with a vacuum pressure monitor 68 by which the vacuum pressure or the degree of vacuum in the outer vacuum container 10 is always monitored.

There are inner vacuum containers 70, 72, 74 in which switches 88, 90, 92 are disposed in the respective inner vacuum containers. In this embodiment, the three switches 88, 90, 92 constitute a desired function of the vacuum switchgear. That is, there are a ground switch or earthing switch, a circuit breaker and a load switch. If necessary, an additional switch such as a disconnector switch is added. The circuit breaker interrupts circuit at an accident to protect the circuit. The load switch switches the power line and a load. The disconnector switch switches off the circuit from the power line, while the circuit is open.

The inner vacuum containers 70, 72, 74 are constituted by cylindrical insulators 76, 78, 80, 82, 84, 86 surrounding the movable electrodes and fixed electrodes, top plate members 88, 90, 92, and bottom plate members 94, 96, 98. Top plate members 88, 90, 92 are connected to the movable electrodes 30, 32, 34 by means of bellows 106, 108, 110. One end of the bellows 106, 108, 110 is connected to the top plate member 88, 90, 92 and the other end is connected to the movable electrode rod 30, 32, 34. The top plate members have through-holes 100, 102, 104 through which the inner vacuum containers communicate with the outer vacuum container. The bottom plate members may also have through-holes. The top plate members and the bottomplate members are made of an electro-conductive material such as stainless steel plate.

Cylindrical electrode shields 112, 114, 116 made of stainless steel, for example, surround the movable electrodes 118, 120, 122 and the fixed electrodes 124, 126, 128. The middle portions of the shields are supported by the insulating shields 76, 78, 80, 82, 84, 86. That is, the electrode shields 112, 114, 116 are so disposed as to prevent metal vapor from scattering or dispersing to outside of the cylindrical shields 112, 114, 116. Further, the movable electrodes 118, 120, 122 are fixed to the movable electrode rods 30, 32, 34 at the ends thereof in the axial direction.

The through-holes 100, 102, 104 formed in the metal plates 88, 90, 92 have such a size that metal vapor generated in the movable electrodes 118, 120, 124 and the fixed electrodes 124, 126, 128 in interrupting or switching off the current does not scatter from the inner vacuum container into the outer vacuum container 10. In interrupting current, if the vacuum degree of the inner vacuum containers decreases temporarily, the size of the through-holes formed in the top or bottom plates 88, 90, 92, 94, 96, 98 have such s size that the vacuum degree of the inner vacuum container immediately recovers.

Figure 2A:
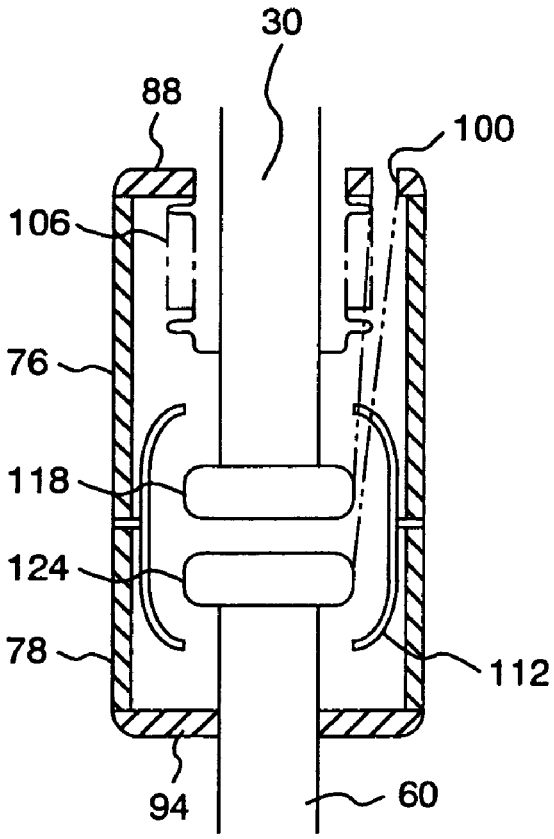
FIG. 2 is a cross sectional view of a main part of the switch used in the embodiment shown in FIG. 1.
Figure 2B:
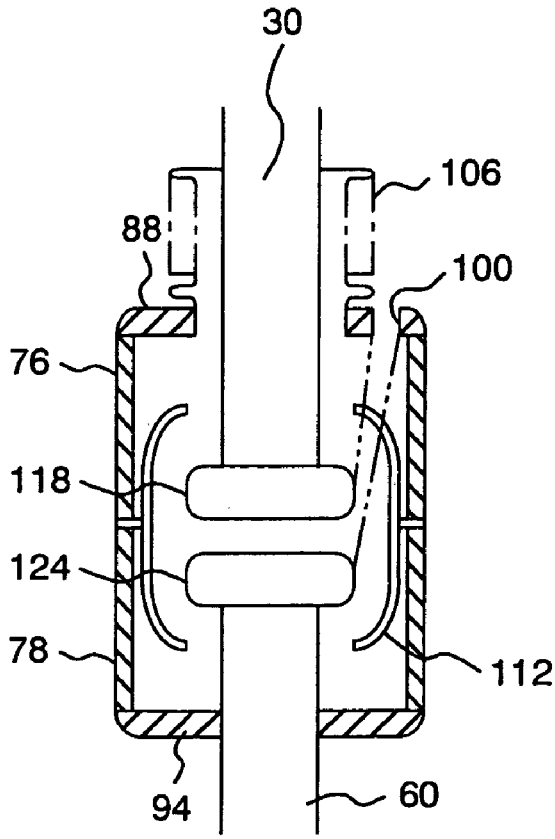

In forming the through-holes 100, 102, 104 in the metal plates 88, 90, 92, the size and shape of the through-holes are determined by the electrode shields 112, 114, 116, as shown in FIG. 2. In FIG. 2(*a*), the inner vacuum container is constituted by a cylindrical insulation shield 78, a movable electrode side metal plate 88 and a fixed electrode side metal plate 94. The inner container covers the movable electrode 118, fixed electrode 124, and the bellows 106 as well. The electrodes 118, 124 are covered with an electrode shield 112. The movable electrode side metal plate has a through-hole that communicates with the outer vacuum container. In FIG. 2(*b*), the structure of the inner vacuum container is the same as that in FIG. 2(*a*), except that a bellows 106 is outside of the inner vacuum container. That is, the electrode shields are preferably disposed within an area defined by a line connecting the outer peripheries of the movable electrodes and the through-holes 100, 102, 104 and broken-lines connecting the outer peripheries of the fixed electrodes 124, 126, 128 and the through-holes 100, 102, 104. By this arrangement, the metal vapor and/or electrons do not scatter from the inner vacuum containers 70, 72, 74 into the outer vacuum container 10 through the through-holes in interrupting current. Since the metal vapor and electrons travel in a straight direction, the above-mentioned structure can prevent scattering and/or leaking of the metal vapor and/or electrons.

Since the vacuum degree in the inner vacuum containers can recover immediately after interruption of current, the reduction in insulation resistance or interruption performance can be avoided. Accordingly, if interrupting current becomes large, it is possible to improve interruption performance without enlarging the volume of the inner vacuum containers 70, 72, 74. The vacuum degree of the outer vacuum container 10 and the inner vacuum containers can be kept equal; the vacuum degree of the outer and inner containers is monitored by the vacuum degree monitor 68.

In the above mentioned embodiment, bellows 106, 108, 110 are disposed in the inner vacuum containers 70, 72, 74. FIG. 3 shows another embodiment wherein bellows are disposed outside of the inner vacuum containers, keeping air-tightness of the inner vacuum containers. According this structure, the volume of the inner vacuum containers can be made minimum.

The through-holes 88, 90, 92 can be formed in the lower plate members 94, 96, 98. The through-holes 100, 102, 104 can be shaded by a suitable plates or members so as to surely prevent scattering of metal vapor and/or electrons.

What is claimed is:

1. A vacuum switchgear comprising:

an electro-conductive outer vacuum container;

a plurality of inner vacuum containers disposed in the outer vacuum container, the inner vacuum containers and the outer container being electrically isolated from each other;

a ground switch, for keeping a circuit open while the switchgear is opened, having a movable electrode, connected to a movable electrode rod, capable of being connected to an operating mechanism, and a fixed electrode capable of being connected to a fixed electrode rod, each of the inner vacuum containers having a top member which is fixed to the movable electrode rod;

at least two function switches each having a function of a circuit breaker for breaking the circuit at the time of an accident, a disconnector for disconnecting the circuit at the time of opening the circuit or a load switch for switching the circuit with a load, and a plurality of electrode shields each surrounding the outer peripheries of the electrodes of the ground switch and of the function switch;

wherein the ground switch and the function switches are disposed in separate inner vacuum containers, respectively, wherein the outer vacuum container and the inner vacuum containers are communicated by means of through-holes formed in the inner vacuum containers, each of the through-holes being disposed outside an aperture, formed around the movable electrode rod, through which the movable electrode rod moves, and wherein a bellows is disposed between the movable electrode and the top member of the inner vacuum containers.

2. The vacuum switch according to claim 1, wherein the through-holes are formed in at least one of the top and bottom walls of the inner vacuum containers in such a manner that leaking out of metallic vapor generated at the electrodes into the outer container is prevented by the shields.

3. The vacuum switchgear according to claim 1, wherein the outer vacuum container is grounded while the vacuum switchgear is in the circuit.

4. The vacuum switchgear according to claim 1, wherein each of the movable electrodes of the ground switch and the function switches is connected to a respective operation mechanism outside of the outer vacuum container, and wherein each of the fixed electrodes is capable of being connected to a cable outside of the outer vacuum container.

5. The vacuum switchgear according to claim 1, wherein the through-holes are formed in the walls of the inner vacuum containers.

6. The vacuum switchgear according to claim 1, wherein each of the inner vacuum containers is constituted by an insulating hollow body surrounding the movable electrode and the fixed electrode, a top member connected in movement relation to the movable electrode, and a bottom member connected in fixed relation to the fixed electrode.

7. The vacuum switchgear according to claim 1, wherein each of the inner vacuum containers is constituted by an insulating shield surrounding the movable and fixed electrodes, and an electrically conductive members disposed at the top and bottom of the shield, at least one of which has the through-hole.

8. The vacuum switchgear according to claim 1, wherein an electrode shield is located within an area confined by a straight line connecting the outermost edge of the movable electrode and the through-hole and a straight line connecting the outermost edge of the fixed electrode and the through-hole.

9. The vacuum switchgear according to claim 1, wherein the outer vacuum container is provided with an opening to be connected to a vacuum pressure monitor.

10. The vacuum switchgear according to claim 7, wherein the switches are a ground switch for grounding the vacuum switchgear while in opening and at least two function switches selected from a circuit breaker for breaking a circuit at accident, and a disconnector switch for disconnecting the circuit.

11. The vacuum switchgear according to claim 10, wherein the function switches are the circuit breaker, the disconnector and a load switch for switching the load conductor and the vacuum switchgear.

* * * * *